US009646782B2

(12) United States Patent
Liao

(10) Patent No.: US 9,646,782 B2
(45) **Date of Patent: *May 9, 2017**

(54) METALLIC BUTTON

(71) Applicants: Fu Tai Hua Industry (Shenzhen) Co., Ltd., Shenzhen (CN); HON HAI PRECISION INDUSTRY CO., LTD., New Taipei (TW)

(72) Inventor: Qian-Long Liao, Shenzhen (CN)

(73) Assignees: Fu Tai Hua Industry (Shenzhen) Co., Ltd., Shenzhen (CN); HON HAI PRECISION INDUSTRY CO., LTD., New Taipei (TW)

( * ) Notice: Subject to any disclaimer, the term of this patent is extended or adjusted under 35 U.S.C. 154(b) by 71 days.

This patent is subject to a terminal disclaimer.

(21) Appl. No.: 14/715,158

(22) Filed: May 18, 2015

(65) Prior Publication Data

US 2016/0196934 A1 Jul. 7, 2016

(30) Foreign Application Priority Data

Jan. 5, 2015 (CN) ..... 2015 2 0004720 U

(51) Int. Cl.
*H01H 13/06* (2006.01)
*H01H 13/86* (2006.01)

(52) U.S. Cl.
CPC ..... *H01H 13/86* (2013.01); *H01H 2223/002* (2013.01); *H01H 2223/008* (2013.01); *H01H 2229/042* (2013.01)

(58) Field of Classification Search
CPC . H01H 13/06; H01H 2223/002; H01H 13/063
USPC ..... 200/302.1, 302.2
See application file for complete search history.

(56) References Cited

U.S. PATENT DOCUMENTS

2011/0056817 A1* 3/2011 Wu ..... H01H 13/14 200/344
2011/0304246 A1* 12/2011 Taniguchi ..... H05K 5/0017 312/223.1
2015/0027868 A1* 1/2015 Gao ..... H01H 13/063 200/341
2015/0041297 A1* 2/2015 Fan ..... H01H 13/14 200/345
2016/0217944 A1* 7/2016 Liao ..... H01H 13/14

* cited by examiner

*Primary Examiner* — Renee S Luebke
*Assistant Examiner* — Ahmed Saeed
(74) *Attorney, Agent, or Firm* — Steven Reiss

(57) ABSTRACT

A metallic button includes a metallic keycap and an annular buffer member. The metallic keycap has a peripheral side surface, and defines an annular receiving groove and a notch communicating with the annular receiving groove on the peripheral side surface. The annular receiving groove extends around the peripheral side surface. The buffer member is composed of flexible material, sleeved on the keycap, and partially received in the annular receiving groove and the notch.

6 Claims, 5 Drawing Sheets

METALLIC BUTTON

FIELD

The subject matter herein generally relates to a metallic button mounted on an electronic device.

BACKGROUND

Electronic devices such as cell phones often include a number of mechanical buttons mounted on housings of the electronic devices. The buttons and the housings are often made of metal. During testing, the housings can be shook to touch or rub the buttons, thus the buttons resonates with the housings to produce a noise.

BRIEF DESCRIPTION OF THE DRAWINGS

Implementations of the present technology will now be described, by way of example only, with reference to the attached figures.

DETAILED DESCRIPTION

Figure 1:
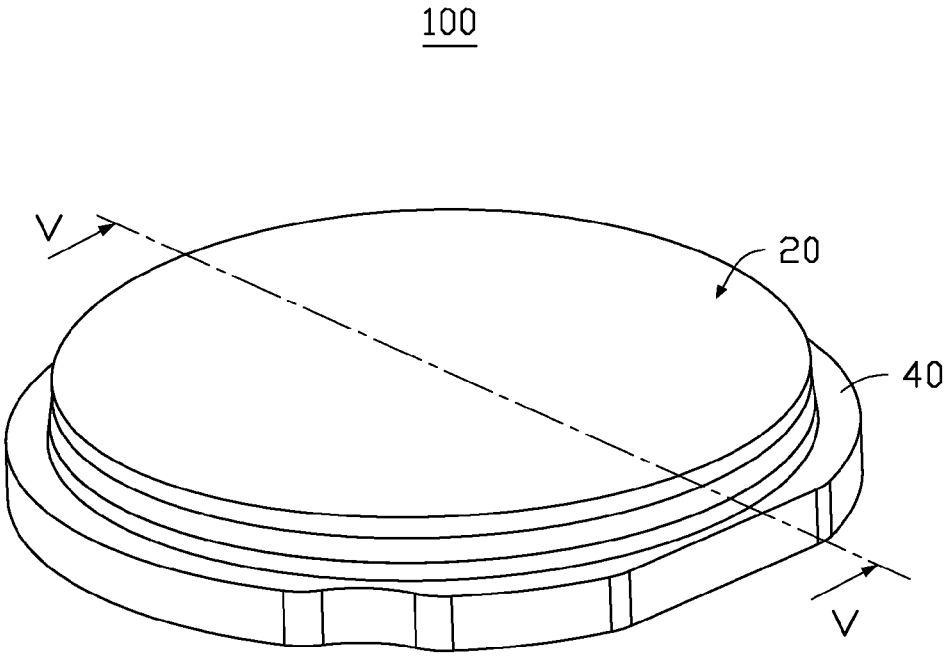
FIG. 1 is an isometric view of an embodiment of a metallic button.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts may be exaggerated to better illustrate details and features of the present disclosure.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "substantially" is defined to be essentially conforming to the particular dimension, shape, or other feature that the term modifies, such that the component need not be exact. For example, "substantially cylindrical" means that the object resembles a cylinder, but can have one or more deviations from a true cylinder. The term "comprising," when utilized, means "including, but not necessarily limited to"; it specifically indicates open-ended inclusion or membership in the so-described combination, group, series and the like.

A metallic button can include a metallic keycap and an annular buffer member. The metallic keycap can have a peripheral side surface, and define an annular receiving groove and a notch communicating with the annular receiving groove on the peripheral side surface. The annular receiving groove can extend around the peripheral side surface. The buffer member can be composed of flexible material, sleeved on the keycap, and partially received in the annular receiving groove and the notch.

Figure 2:
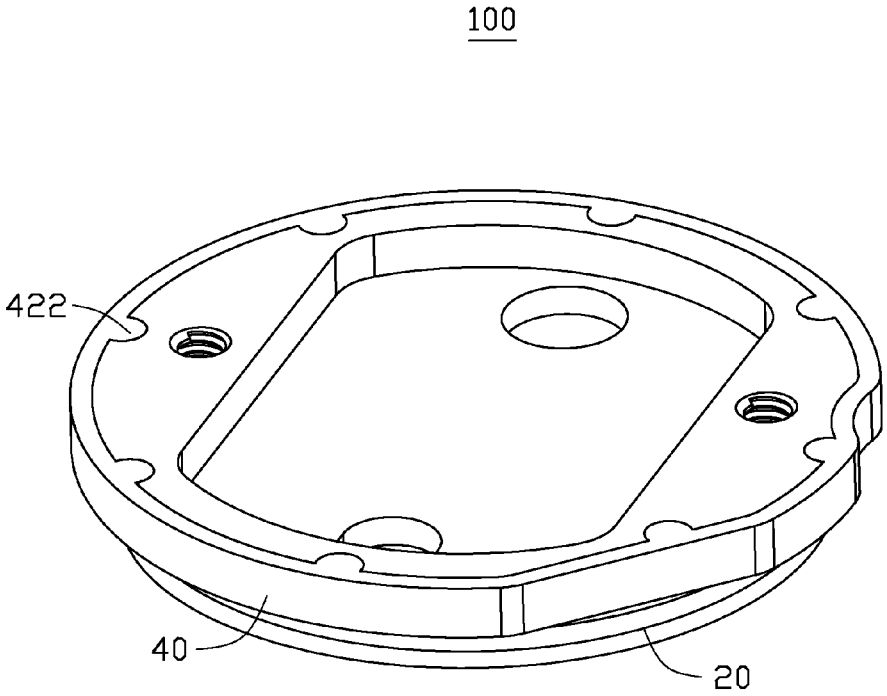
FIG. 2 is similar to FIG. 1, but viewed from another angle.

FIGS. 1 and 2 illustrate an embodiment of a metallic button 100. The metallic button 100 can include a keycap 20, and a buffer member 40 sleeved on the keycap 20. The buffer member 40 can be partially embedded in the keycap 20. The metallic button 100 can be mounted on a mounting hole of an electronic device (not shown). The electronic device can be a cell phone, a tablet computer, a television, and so on.

Figure 3:
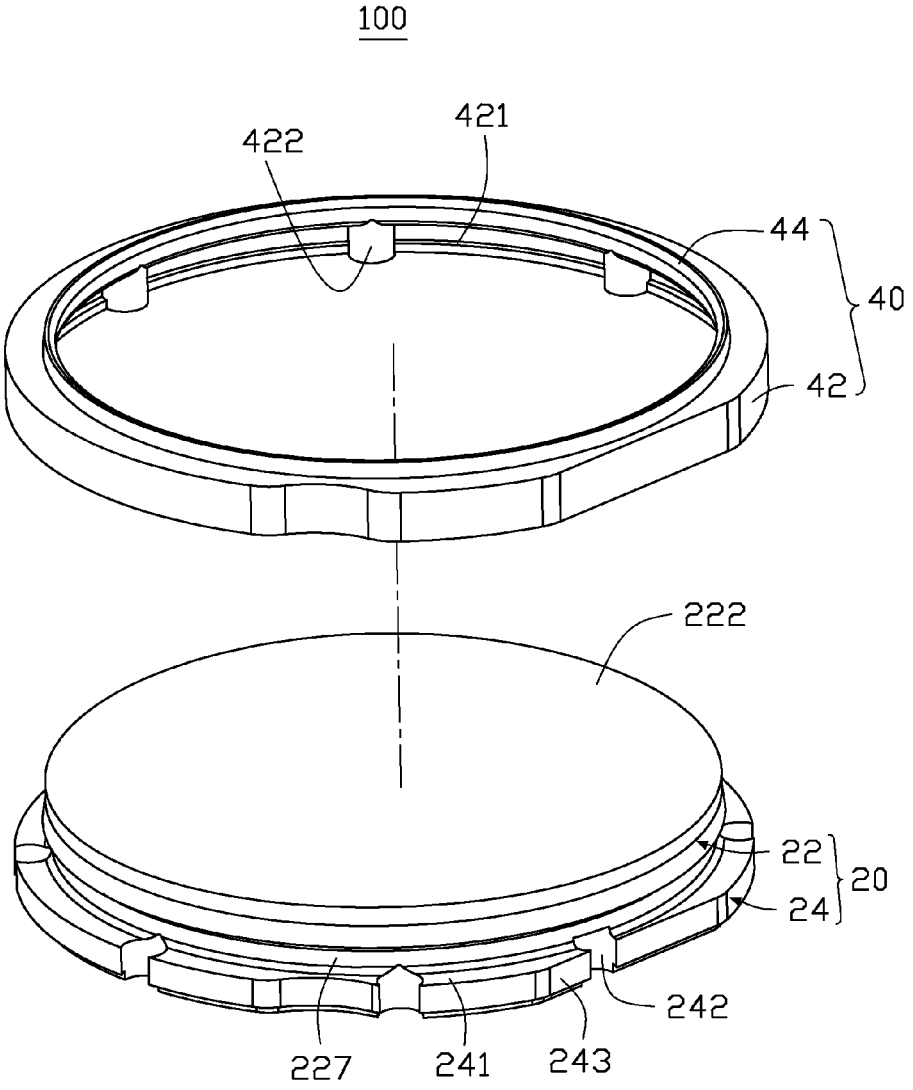
FIG. 3 is an exploded, isometric view of the metallic button of FIG. 1.
Figure 4:
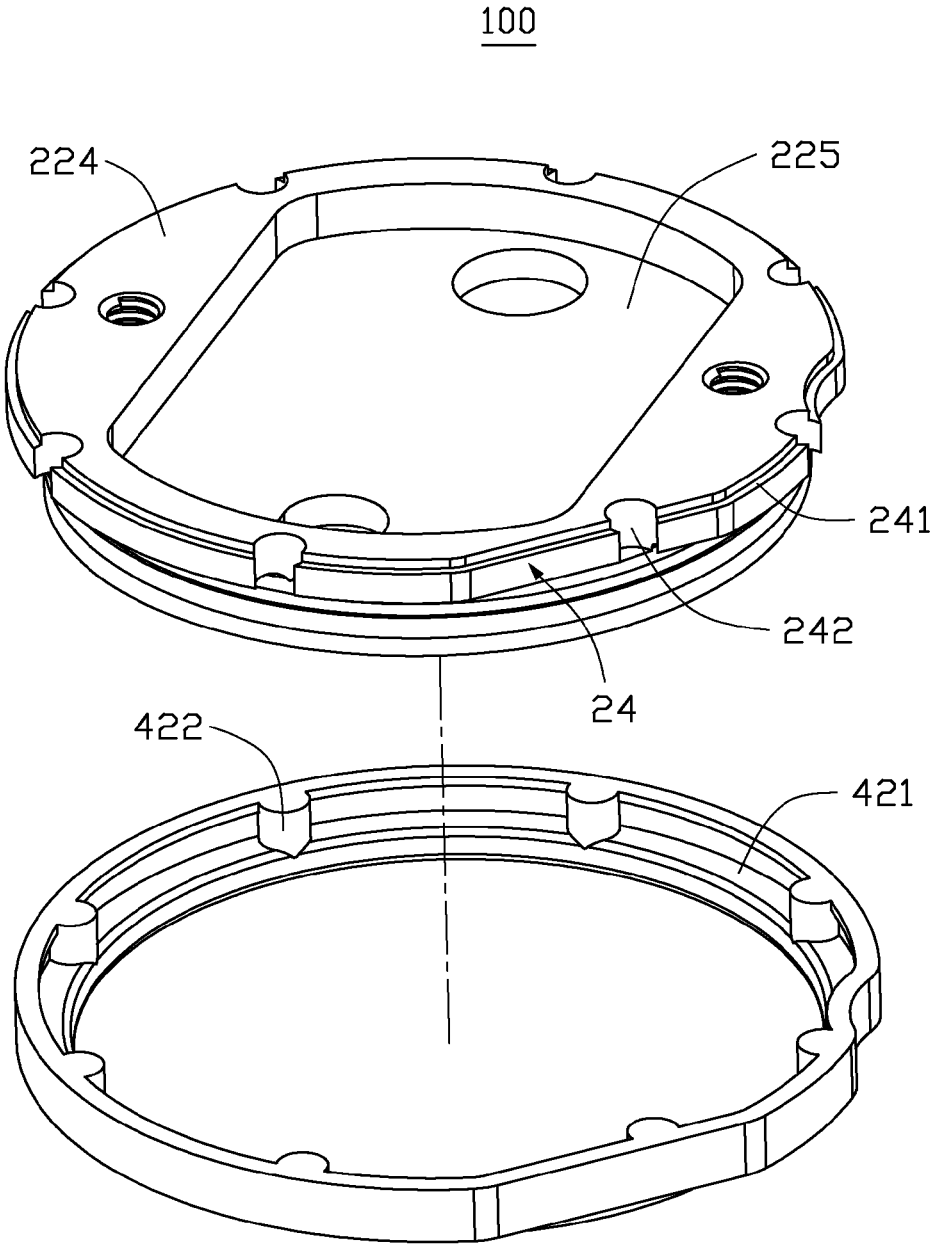
FIG. 4 is an exploded, isometric view of the metallic button of FIG. 2.
Figure 5:
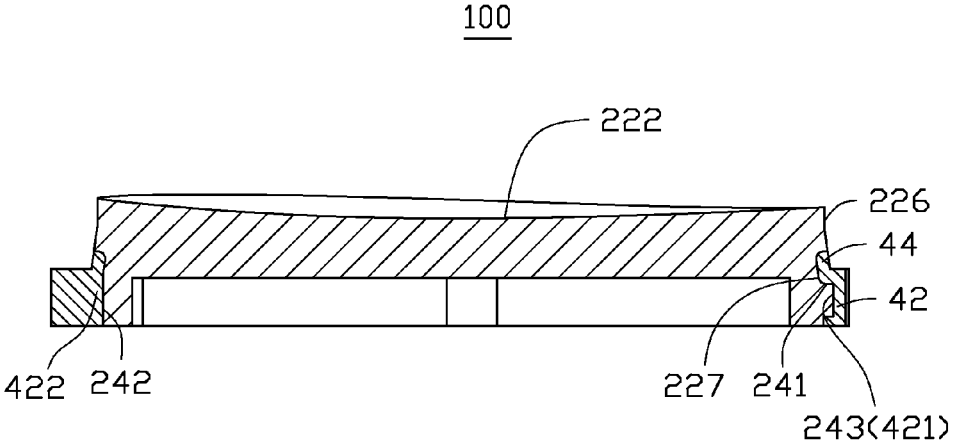
FIG. 5 is a cross-sectional view of the metallic button of FIG. 1, taken along line V-V of FIG. 1.

FIGS. 3 to 5 illustrate that the keycap 20 can be substantially cylindrical. The keycap 20 can include a pressing portion 22 and a protrusion portion 24. The pressing portion 22 can be substantially cylindrical, and received in the mounting hole (not shown), to move along a central axis of the mounting hole in the mounting hole. The pressing portion 22 can include a pressing surface 222, a mounting surface 224 opposite to the pressing surface 222, and a peripheral side surface 226 interconnecting the pressing surface 222 and the mounting surface 224. The pressing surface 222 can sink from an end of the peripheral side surface 226 toward a center of the pressing portion 22. The pressing portion 22 can define a mounting groove 225 on the mounting surface 224. The mounting groove 225 can be configured to receive functional elements of the electronic device 100, and can communicate with the mounting hole. The pressing portion 22 can define an annular receiving groove 227 on the peripheral side surface 226. The annular receiving groove 227 can extend around the peripheral side surface 226.

The protrusion portion 24 can protrude from the peripheral side surface 226 of the pressing portion 22 adjacent to the annular receiving groove 227. The protrusion portion 24 can be configured to couple to a housing of the electronic device (not shown), and can allow a predetermined distance to be defined between the pressing portion 22 and the housing of the electronic device, thus the pressing portion 22 does not touch an inner surface of the mounting hole of the electronic device. The protrusion portion 24 can be substantially annular. The protrusion portion 24 can have two opposite side surfaces 241, and an end face 243 interconnecting the side surfaces 241 and located away from the peripheral side surface 226. One side surface 241 can be coupled to the peripheral side surface 226, and another side surface 241 can align with one side surface of the annular receiving groove 227. The protrusion portion 24 can define a number of notches 242 which pass through the side surfaces 241 and the end face 243. Each notch 242 can communicate with the annular receiving groove 227. The notches 242 can be separate from each other. In at least one embodiment, the protrusion portion 24 defines one notch 242.

The buffer member 40 can be substantially annular, and can include a buffer portion 42 and a connecting portion 44. The buffer portion 42 can be substantially annular. The buffer portion 42 can be sleeved on the protrusion portion 24, and can completely separate the keycap 20 from the housing of the electronic device. Thus, the keycap 20 cannot touch the housing of the electronic device. The buffer portion 42 can include an inner surface 421. A number of latching blocks 422 can protrude from the inner surface 421 of the buffer portion 42, matching the notches 242. Each latching block 422 can be received in the corresponding notch 242. The connecting portion 44 can axially extend from an end of the inner surface 421, to be received in the annular receiving groove 227, and can align with the peripheral side surface 226 of the pressing portion 22 of the keycap 20. The buffer member 40 can be composed of flexible material, such as silica gel, and rubber.

In at least one embodiment, the keycap 20 can be composed of metal, such as aluminum, and aluminum alloy; the buffer member 40 can be composed of silica gel; and the buffer member 40 can be integrated with the keycap 20 via a compression molding method. Unlike injection molding, compression molding can prevent the anodic oxide film coated on the surface of the keycap 20 from breaking under high temperature.

While the present disclosure has been described with reference to particular embodiments, the description is illustrative of the disclosure and is not to be construed as limiting the disclosure. Therefore, those of ordinary skill in the art can make various modifications to the embodiments without departing from the scope of the disclosure, as defined by the appended claims.

What is claimed is:

1. A metallic button comprising:

a metallic keycap having a peripheral side surface, and defining an annular receiving groove and a notch communicating with the annular receiving groove on the peripheral side surface, the annular receiving groove extending around the peripheral side surface; and an annular buffer member composed of flexible material, sleeved on the keycap, and partially received in the annular receiving groove and the notch, wherein the annular buffer member comprises a buffer portion, the buffer portion defines an inner surface, a latching block matching the notch protrudes from the inner surface of the buffer portion, and the latching block is received in the notch.

2. The metallic button of claim 1, wherein the keycap comprises:

a pressing portion having the peripheral side surface; and a protrusion portion protruding from the peripheral side surface, and having two opposite side surfaces and an end face interconnecting the side surfaces and located away from the peripheral side surface;

the annular receiving groove is defined on the peripheral side surface of the pressing portion, and the notch passes through the side surfaces and the end face.

3. The metallic button of claim 2, wherein the pressing portion further comprises:

a pressing surface sinking from a peripheral side of the pressing portion toward a center of the pressing portion; and a mounting surface opposite to the pressing surface;

the peripheral side surface interconnects the pressing surface and the mounting surface.

4. The metallic button of claim 3, wherein the pressing portion defines a mounting groove on the mounting surface.

5. The metallic button of claim 1, wherein the buffer member comprises:

a connecting portion protruding from an end of the inner surface of the buffer portion, and received in the annular receiving groove.

6. The metallic button of claim 1, wherein the buffer member is composed of silica gel or rubber.

* * * * *